US010832621B2

(12) United States Patent
He

(10) Patent No.: US 10,832,621 B2
(45) Date of Patent: Nov. 10, 2020

(54) BACKLIGHT ADJUSTMENT METHOD OF DISPLAY PANEL, BACKLIGHT ADJUSTMENT DEVICE, AND DISPLAY DEVICE REDUCING RED PIXEL COLOR SHIFT

(71) Applicant: HKC CORPORATION LIMITED, Guangdong (CN)

(72) Inventor: Huailiang He, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 16/313,971

(22) PCT Filed: Jan. 16, 2018

(86) PCT No.: PCT/CN2018/072826
§ 371 (c)(1),
(2) Date: Dec. 28, 2018

(87) PCT Pub. No.: WO2019/119588
PCT Pub. Date: Jun. 27, 2019

(65) Prior Publication Data

US 2019/0228720 A1 Jul. 25, 2019

(51) Int. Cl.
*G09G 3/34* (2006.01)
*G09G 3/36* (2006.01)

(52) U.S. Cl.
CPC ..... *G09G 3/3413* (2013.01); *G09G 3/36* (2013.01); *G09G 2320/0626* (2013.01)

(58) Field of Classification Search
CPC ..... G09G 3/3406; G09G 3/3413; G09G 3/36; G09G 3/3607; G09G 2320/0626;
(Continued)

(56) References Cited

U.S. PATENT DOCUMENTS

2003/0053689 A1* 3/2003 Watanabe ..... G06T 5/004 382/167
2007/0216636 A1* 9/2007 Lo ..... G09G 3/3406 345/102
(Continued)

FOREIGN PATENT DOCUMENTS

CN 104346817 A 2/2015
CN 106683627 A 5/2017
(Continued)

OTHER PUBLICATIONS

International Search Report for Application No. PCT/CN2018/072826 dated Sep. 26, 2018, 11 pages.

*Primary Examiner* — Alexander Eisen
*Assistant Examiner* — Nelson Lam
(74) *Attorney, Agent, or Firm* — Seyfarth Shaw LLP; Joseph Lanser

(57) ABSTRACT

The adjustment method includes: acquiring a first component, a second component, and a third component of each of the pixel units in the pixel area in a first color space; acquiring a tone angle value and a saturation in a second color space according to an average value of the first component, an average value of the second component, and an average value of the third component of the pixel unit in the pixel area; acquiring specified lightness of a blue backlight module and a green backlight module in the backlight module area according to the tone angle value and the saturation; and performing at least one of the following two steps: adjusting lightness of the blue backlight module according to the specified lightness of the blue backlight module; and adjusting lightness of the green backlight module according to the specified lightness of the green backlight module.

10 Claims, 6 Drawing Sheets

(58) Field of Classification Search
CPC .... G09G 3/364; G09G 3/3648; G09G 3/3688; G09G 3/3692; G09G 5/026; G09G 5/06
USPC ..... 345/87–104
See application file for complete search history.

(56) References Cited

U.S. PATENT DOCUMENTS

| | | | | |
|---|---|---|---|---|
| 2009/0009539 | A1 | 1/2009 | Ahn et al. | |
| 2009/0058876 | A1* | 3/2009 | Wang | G09G 3/3413 345/590 |
| 2011/0227818 | A1* | 9/2011 | Su | G09G 3/2003 345/102 |
| 2014/0240341 | A1* | 8/2014 | Oda | G09G 3/3406 345/590 |
| 2014/0240367 | A1* | 8/2014 | Kim | G09G 3/3648 345/690 |
| 2018/0330680 | A1* | 11/2018 | Chen | G09G 3/3607 |
| 2019/0304380 | A1* | 10/2019 | Kang | G09G 3/342 |
| 2020/0066217 | A1* | 2/2020 | Kang | G09G 3/3607 |
| 2020/0074944 | A1* | 3/2020 | Kang | G09G 3/20 |

FOREIGN PATENT DOCUMENTS

| | | | |
|---|---|---|---|
| CN | 106981275 | A | 7/2017 |
| CN | 107863085 | A | 3/2018 |
| CN | 107863086 | A | 3/2018 |
| CN | 108062937 | A | 5/2018 |
| KR | 20010045098 | A | 6/2001 |

* cited by examiner

BACKLIGHT ADJUSTMENT METHOD OF DISPLAY PANEL, BACKLIGHT ADJUSTMENT DEVICE, AND DISPLAY DEVICE REDUCING RED PIXEL COLOR SHIFT

CROSS REFERENCE TO RELATED APPLICATIONS

This is a National Stage application of, and claims priority to, PCT/CN2018/072826, filed Jan. 16, 2018, which claims priority to Chinese Patent Application No. 201711382393.7, filed Dec. 20, 2017, the disclosures of which are incorporated herein by reference in their entirety.

TECHNICAL FIELD

Embodiments of the present disclosure relate to the field of display technologies, and more particularly relate to a backlight adjustment method of a display panel, a backlight adjustment device, and a display device.

BACKGROUND

With the increasing application of liquid crystal display devices, the color shift phenomenon of the liquid crystal display device under a large viewing angle has become an urgent problem to be solved in the development of liquid crystal display panels.

The liquid crystal display device generally includes a plurality of pixel units. In addition to being affected by the penetration spectrum of a red color resist in a color film substrate in the liquid crystal display device, a color rendered by a red pixel unit is also affected by the penetration spectrum of the liquid crystal and the emission spectrum of the light source. The red color resist has a phenomenon of penetrating light leakage for some short-wavelength light, resulting in the color of the red pixel unit being orange-red. The transmittance of short-wavelength light has a ratio compared to the transmittance of long-wavelength light, which is much larger than the front view in the case of a large viewing angle, resulting in a severe color shift of the red pixel unit in the case of a large viewing angle.

SUMMARY

Accordingly, embodiments of the present disclosure provide a backlight adjustment method of a display panel, a backlight adjustment device, and a display device, which can solve the problem of a severe color shift of a red pixel unit caused by the short-wavelength light, thereby optimizing the display effect of the display device.

The embodiments of the present disclosure provide a backlight adjustment method of a display panel. The display panel includes at least one pixel area and at least one backlight module area. The pixel area and the backlight module area are in one-to-one correspondence. Each of the pixel areas includes a plurality of pixel units. The adjustment method includes:

acquiring a first component, a second component, and a third component of each of the pixel units in the pixel area in a first color space;

acquiring a tone angle value and a saturation in a second color space according to an average value of the first component, an average value of the second component, and an average value of the third component of the pixel unit in the pixel area;

acquiring specified lightness of a blue backlight module and a green backlight module in the backlight module area corresponding to the pixel area according to the tone angle value and the saturation; and performing at least one of the following two steps: adjusting lightness of the blue backlight module according to the specified lightness of the blue backlight module; and adjusting lightness of the green backlight module according to the specified lightness of the green backlight module;

the specified lightness of the blue backlight module is less than lightness of the blue backlight module before adjustment, and the specified lightness of the green backlight module is less than lightness of the green backlight module before adjustment.

Optionally, the acquiring the specified lightness of the blue backlight module and the green backlight module according to the tone angle value and the saturation includes:

when the tone angle value is greater than 0 degrees and is less than or equal to 45 degrees, acquiring the specified lightness of the blue backlight module and the green backlight module according to the saturation.

Optionally, the acquiring the specified lightness of the blue backlight module and the green backlight module according to the tone angle value and the saturation includes:

when the tone angle value is greater than 315 degrees and is less than or equal to 360 degrees, acquiring the specified lightness of the blue backlight module and the green backlight module according to the saturation.

Optionally, the first color space is a Red Green Blue RGB color space.

Optionally, the second color space is an LCH color space.

Optionally, the display panel is a liquid crystal display panel.

The embodiments of the present disclosure provide a backlight adjustment device of a display panel. The display panel includes at least one pixel area and at least one backlight module area. The pixel area and the backlight module area are in one-to-one correspondence. Each of the pixel areas includes a plurality of pixel units. The adjustment device includes:

a component acquiring module configured to acquire a first component, a second component, and a third component first color space of each of the pixel units in the pixel area in a first color space;

a tone saturation acquiring module electrically coupled to the component acquiring module, wherein the tone saturation acquiring module is configured to acquire a tone angle value and a saturation in a second color space according to an average value of the first component, an average value of the second component, and an average value of the third component of the pixel unit in the pixel area;

a specified lightness acquiring module electrically coupled to the tone saturation acquiring module, wherein the specified lightness acquiring module is configured to acquire specified lightness of a blue backlight module and a green backlight module corresponding to the pixel area according to the tone angle value and the saturation;

a backlight lightness adjustment module electrically coupled to the specified lightness acquiring module, wherein the backlight lightness adjustment module is configured to perform at least one of the following two steps: adjusting lightness of the blue backlight module according to the specified lightness of the blue backlight module; and adjusting lightness of the green backlight module according to the specified lightness of the green backlight module; and a control module electrically coupled to the backlight lightness adjustment module, wherein the control module is configured to control the specified lightness of the blue backlight module to be less than lightness of the blue backlight module before adjustment, and the specified lightness of the green backlight module to be less than lightness of the green backlight module before adjustment.

Optionally, the specified lightness acquiring module is further configured to:

when the tone angle value is greater than 0 degrees and is less than or equal to 45 degrees, acquire the specified lightness of the blue backlight module and the green backlight module according to the saturation.

Optionally, the acquiring the specified lightness of the blue backlight module and the green backlight module according to the tone angle value and the saturation includes:

when the tone angle value is greater than 315 degrees and is less than or equal to 360 degrees, acquiring the specified lightness of the blue backlight module and the green backlight module according to the saturation.

Optionally, the first color space is a Red Green Blue RGB color space.

Optionally, the second color space is an LCH color space.

Optionally, the display panel is a liquid crystal display panel.

The embodiments of the present disclosure provide a display device, which includes the aforementioned backlight adjustment device, a backlight module, and a display panel;

the backlight adjustment device is electrically coupled to the backlight module, the backlight adjustment device is configured to adjust lightness of the backlight module;

the backlight module is located under the display panel, the backlight module is configured to provide a light source to the display panel.

Optionally, the display panel includes an array substrate.

Optionally, the display panel further includes a color film substrate, the color film substrate is located at a side of the array substrate away from the backlight module.

The embodiments of the present disclosure further provide a backlight adjustment method of a display panel, which includes:

dividing pixel units in the display panel into a plurality of pixel areas, each of the pixel areas comprising a plurality of pixel units;

dividing backlight modules in the display panel into a plurality of backlight module areas, each of the backlight module areas corresponding to a pixel area consisting of the pixel units;

acquiring a first component, a second component, and a third component first color space of the pixel unit in the pixel area in a first color space;

acquiring a tone angle value and a saturation in a second color space according to an average value of the first component, an average value of the second component, and an average value of the third component of the pixel unit in the pixel area;

when the tone angle value is greater than 0 degree and is less than or equal to 45 degrees, or is greater than 315 degrees and is less than or equal to 360 degrees, corresponding specified lightness of a blue backlight module and a green backlight module in the backlight module area of the pixel unit in the pixel area according to the saturation; and performing at least one of the following two steps: adjusting lightness of the blue backlight module in the backlight module area according to the specified lightness of the blue backlight module in the backlight module area; and adjusting lightness of the green backlight module in the backlight module area according to the specified lightness of the green backlight module in the backlight module area;

the specified lightness of the blue backlight module is less than lightness of the blue backlight module before adjustment, and the specified lightness of the green backlight module is less than lightness of the green backlight module before adjustment.

Optionally, the first color space is a Red Green Blue RGB color space.

Optionally, the second color space is an LCH color space.

Optionally, the display panel is a liquid crystal display panel.

The embodiments of the present disclosure further provide a computer readable storage medium storing computer executable instructions configured to perform any of the above methods.

The embodiments of the present disclosure further provide a backlight adjustment apparatus. The backlight adjustment apparatus includes one or more processors, a memory, and one or more programs. The one or more programs are stored in the memory, and when executed by the one or more processors, the above method is performed.

The embodiments of the present disclosure further provide a computer program product. The computer program product includes a computer program stored on a non-transitory computer readable storage medium. The computer program includes program instructions, which, when executed by a computer cause the computer to perform any of the methods described above.

DETAILED DESCRIPTION OF THE EMBODIMENTS

Figure 1:
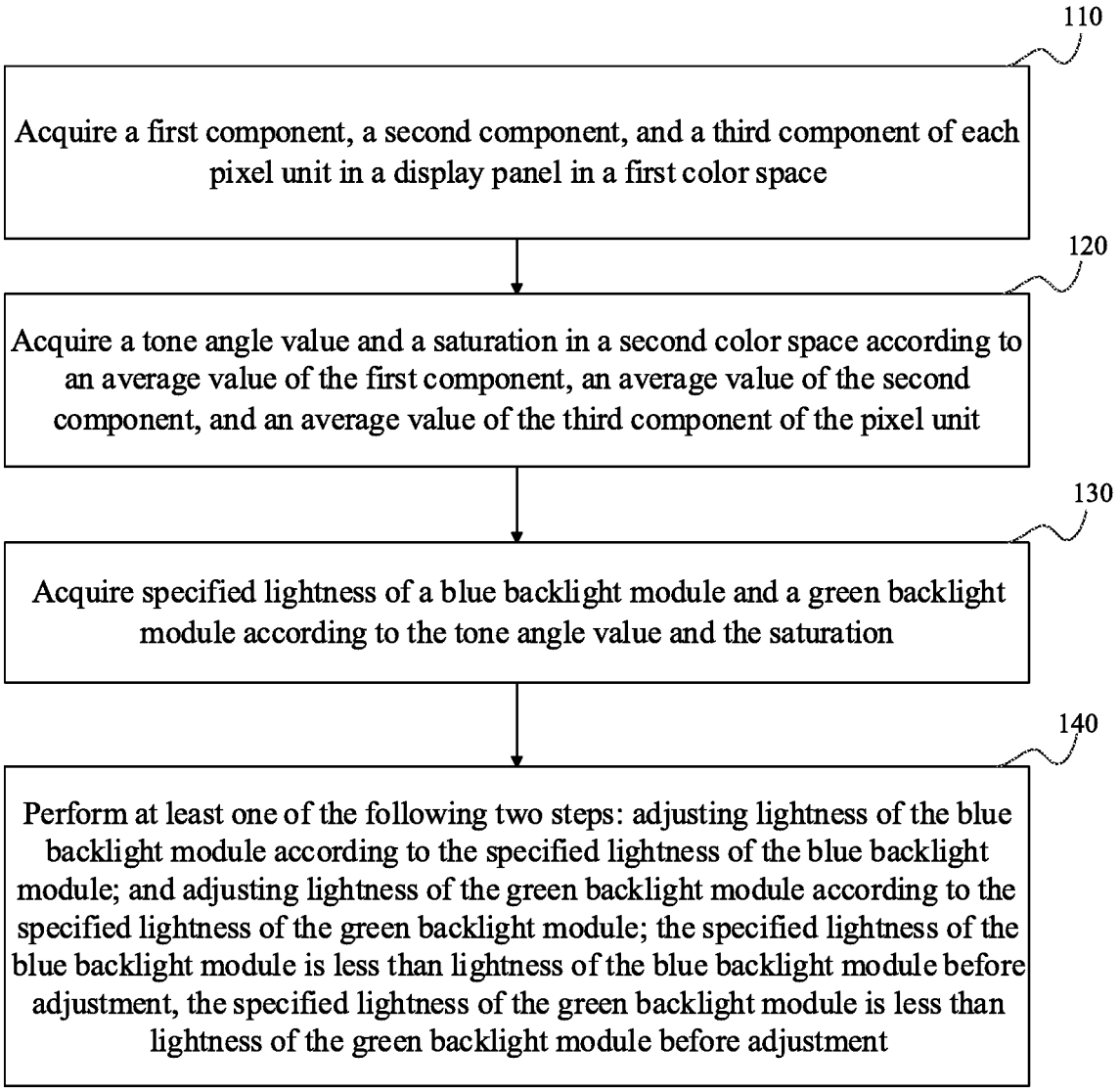
FIG. 1 is a flowchart of a backlight adjustment method of a display panel according to an embodiment.

FIG. 1 is a flowchart of a backlight adjustment method of a display panel according to the embodiments of the present disclosure. The backlight adjustment method can be applied to a scene in which lightness of the backlight module in the display panel is required to be adjusted, and can be performed by the backlight adjustment device provided by the embodiments of the present disclosure. The display panel includes at least one pixel area and at least one backlight module area. The pixel area and the backlight module area are in one-to-one correspondence. Each of the pixel areas includes a plurality of pixel units. When all pixel units in the display panel belong to one pixel area, and the pixel area corresponds to one backlight module area, the method includes:

In step 110, a first component, a second component, and a third component of each of the pixel units in the display panel in a first color space are acquired.

In step 120, a tone angle value and a saturation in a second color space are acquired according to an average value of the first component, an average value of the second component, and an average value of the third component of the pixel unit.

Exemplarily, the first color space may be an RGB color space, then the first component may be an R component, the second component may be a G component, and the third component may be a B component. The RGB color space is defined based on the color recognized by the human eye. Three values of the tone angle value, lightness, and the saturation are represented together, such that the R component, the G component, and the B component are correlated with each other, that is, the R component, the G component, and the B component are not independent from each other.

Exemplarily, the first component, the second component, and the third component of each of the pixel units in the display panel in the first color space are acquired, thereby acquiring the average value Ave R of the first component, the average value Ave G of the second component, and the average value Ave B of the third component of all pixel units in the display panel. The second color space may be exemplarily configured to an LCH color space. The RGB color space may be converted to the LCH color space (L is lightness, C is saturation, and H is tone angle value), in which the lightness L, the saturation C, and the tone angle value H are independent from each other, and the determination of parameter of the pixel unit in the display panel can be performed according to a single component. The tone angle value H and the saturation C in the second color space can be acquired according to the acquired average value Ave R of the first component, the average value Ave G of the second component, and the average value Ave B of the third component of the pixel unit. For example, H can be equal to f1 (Ave R, Ave G, Ave B), and C can be equal to f2 (Ave R, Ave G, Ave B).

In step 130, specified lightness of a blue backlight module and a green backlight module are acquired according to the tone angle value and the saturation.

The specified lightness of the blue backlight module and the green backlight module can be acquired according to the acquired tone angle value and the saturation in the second color space. Referring to an LCH color space, when the tone angle value according to the pixel unit is 0°, the pixel unit renders a pure red color. When the tone angle value according to the pixel unit is 90°, the pixel unit renders a pure yellow color. When the tone angle value according to the pixel unit is 180°, the pixel unit renders a pure green color. When the tone angle value according to the pixel unit is 270°, the pixel unit renders a pure blue color. As the tone angle value H of the pixel unit changes from 0° to 360°, the color rendered by the pixel unit gradually changes from pure red color to pure yellow color, then to pure green color, then to pure blue color, and then back to pure red color. In addition, the range of the saturation of the pixel unit in the LCH color space may be greater than or equal to 0 and less than or equal to 100. When the saturation is 100, the color of the pixel unit is most vivid.

Optionally, when the tone angle value H is greater than 0 degree and is less than or equal to 45 degrees, or is greater than 315 degrees and is less than or equal to 360 degrees, the specified lightness of the blue backlight module and the green backlight module can be acquired according to the saturation C. When the acquired tone angle value H is greater than 0° and is less than or equal to 45°, or is greater than 315° and is less than or equal to 360°, it can be determined that the pixel unit in the display panel renders a color close to red color, and then the range in which the acquired saturation C is located is determined. For example, when the acquired saturation C is greater than C1 and less than C2, it can be determined that the specified lightness of the blue backlight module is A_B1, and the lightness of the green backlight module is A_G1.

The determination of the saturation C can be defined in a specific range according to the user's requirement of the saturation of a red pixel unit in the display panel, which is not limited in the embodiment of the present disclosure.

Exemplarily, the adjustment of lightness of the green backlight module and the blue backlight module can be adjusted according to the actual characteristics of the display panel, as long as adjusted specified lightness of the green backlight module is less than lightness of the green backlight module before adjustment, and adjusted specified lightness of the blue backlight module is less than lightness of the blue backlight module before adjustment. Exemplarily, when the color rendered by an image quality in the display panel is close to red, compared to the other color rendered by the image quality in the display panel, an adjustment ratio of lightness of the green backlight module and the blue backlight module can be increased. In other words, a decreasing ratio of lightness of the green backlight module and the blue backlight module can be increased. When the color rendered by the image quality in the display panel is close to yellow, the adjustment ratio of lightness of the blue backlight module is increased, and lightness of the green backlight module cannot be adjusted or be adjusted less according to the characteristics required for display.

In step 140, at least one of the following two steps is performed: adjusting lightness of the blue backlight module according to the specified lightness of the blue backlight module; and adjusting lightness of the green backlight module according to the specified lightness of the green backlight module. The specified lightness of the blue backlight module is less than lightness of the blue backlight module before adjustment, and the specified lightness of the green backlight module is less than lightness of the green backlight module before adjustment.

The lightness of the blue backlight module can be adjusted according to the specified lightness of the blue backlight module obtained in the aforementioned steps, or the lightness of the green backlight module can be adjusted according to the obtained specified lightness of the green backlight module. Alternatively, the lightness of blue backlight module can be adjusted according to the specified lightness of the blue backlight module, meanwhile the lightness of the green backlight module is adjusted according to the specified lightness of the green backlight module. Since the specified lightness of the blue backlight module is less than the lightness of the blue backlight module before adjustment, and the specified lightness of the green backlight module is less than the lightness of the green backlight module before adjustment, that is, the adjusted lightness of the blue backlight module is configured to the specified lightness to reduce the lightness of the blue backlight module, and the adjusted lightness of the green backlight module is configured to the specified lightness to reduce the lightness of the green backlight module, whether the blue backlight module or the green backlight module is adjusted according to the specified lightness, or the lightness of the blue backlight module and the green backlight module are simultaneously adjusted, the light leakage of the short-wavelength light to the red pixel unit can be reduced, the problem of severe color shift of the red pixel unit caused by the short-wavelength light can be solved, thereby optimizing the display effect of the display device.

Figure 2:
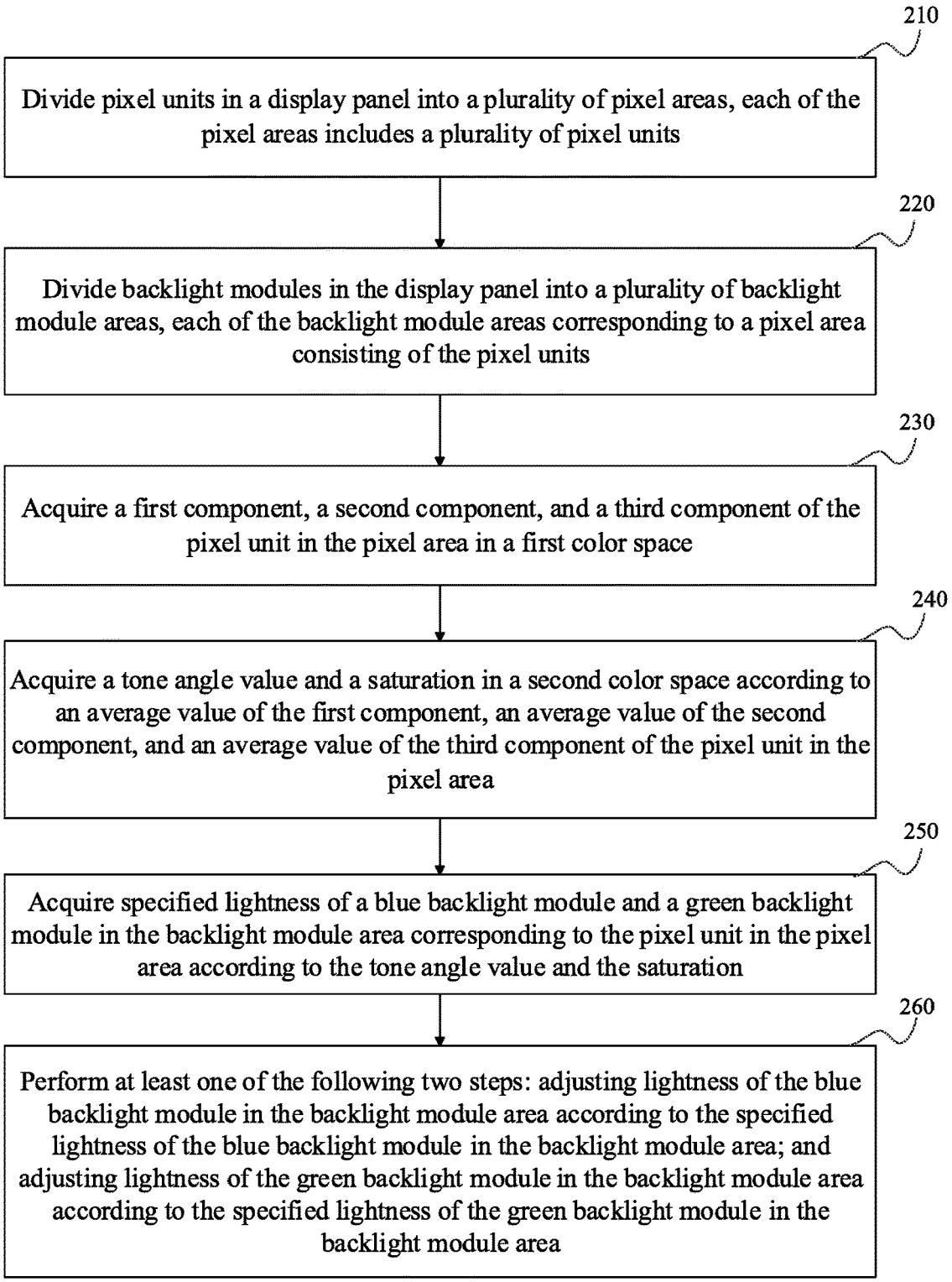
FIG. 2 is a flowchart of another backlight adjustment method of a display panel according to an embodiment.

Optionally, FIG. 2 is a flowchart of another backlight adjustment method of a display panel according to the present embodiment. The method can also be performed by the backlight adjustment device provided by the embodiments of the present disclosure. When all pixel units in the display panel belong to a plurality of pixel areas, the method includes:

In step 210, pixel units in the display panel are divided into a plurality of pixel areas, and each of the pixel areas includes a plurality of pixel units.

The display panel can include a plurality of pixel units arranged in a matrix, that is, a plurality of rows and columns of pixel units. The pixel unit in the display panel can be divided into a plurality of pixel areas. Each of the pixel areas can include a plurality of rows and columns of pixel units therein, that is, each of the pixel areas includes a plurality of pixel units.

In step 220, backlight modules in the display panel are divided into a plurality of backlight module areas, and each of the backlight module areas is disposed corresponding to a pixel area consisting of the pixel units.

Figure 3:
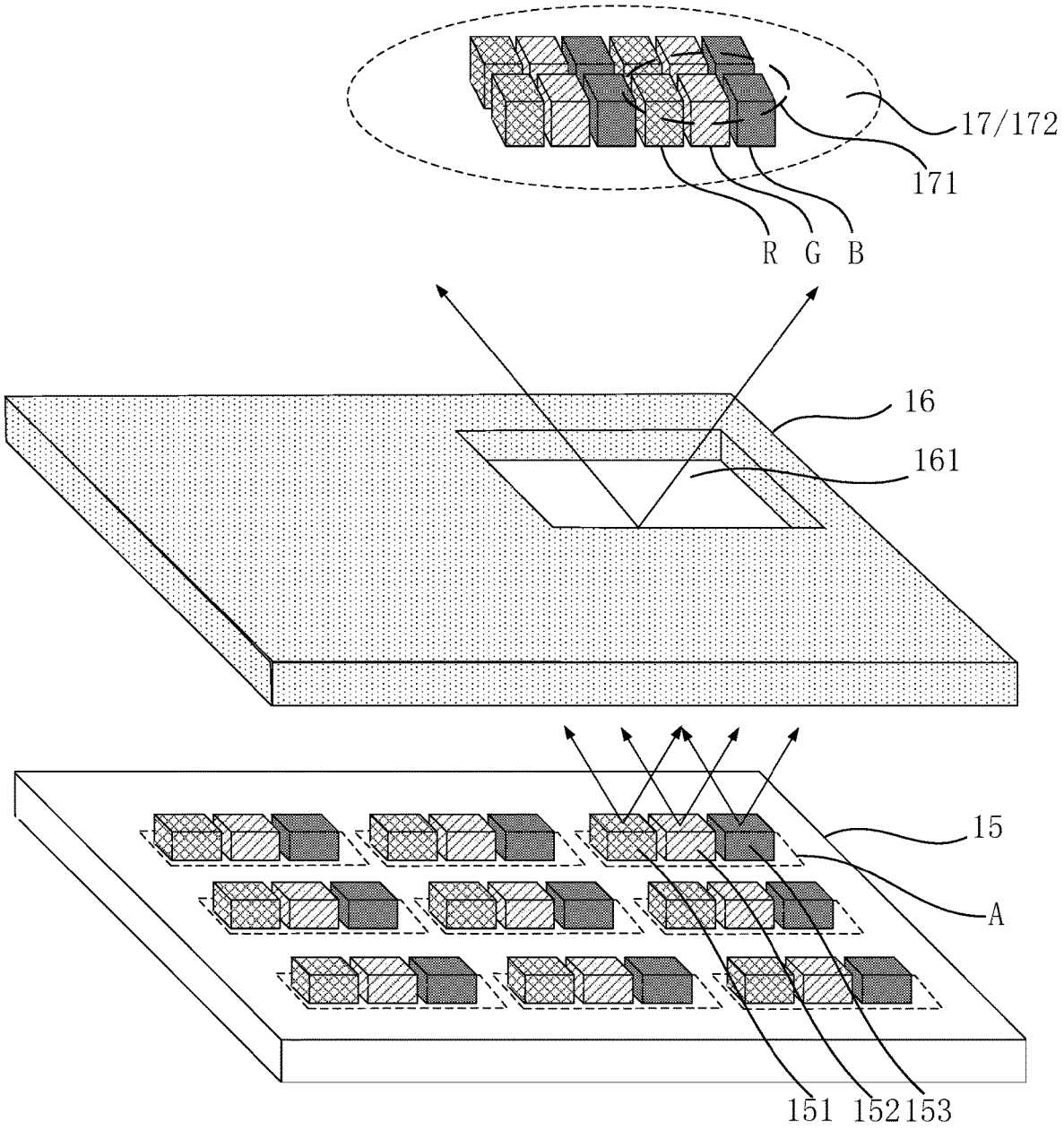
FIG. 3 is a schematic view of a display device according to an embodiment.

Exemplarily, FIG. 3 is a schematic view of a display device according to the embodiments of the present disclosure. The display device can be, for example, a liquid crystal display device. Referring to FIG. 3, the display device can include a display panel and a backlight module 15 located under the display panel. The backlight module 15 is used to provide light source for display to the display panel. The display panel can include an array substrate 16 adjacent to the backlight module, and a color film substrate 17 located at a side of the array substrate 16 away from the backlight module 15 (only a partial area is shown). The backlight module 15 can include a plurality of red backlight modules 151, a plurality of green backlight modules 152, and a plurality of blue backlight modules 153. The color film substrate 17 may include a plurality of pixel units 171 thereon. In FIG. 3, pixel units in the display panel are exemplarily divided into a plurality of areas 172 every four pixel units (only one area is shown in FIG. 3). Each of the pixel units 171 in each of the areas 172 can include a red pixel unit R, a green pixel unit G, and a blue pixel unit B. The light emitted by the backlight module 15 can be irradiated onto a liquid crystal layer (not shown) between the array substrate 16 and the color film substrate 17 through an opening area 161 on the array substrate 16, thereby achieving a normal function of the liquid crystal display panel. Exemplarily, referring to FIG. 3, a backlight module area A consisting of the red backlight module 151, the green backlight module 152, and the blue backlight module 153 can be provided corresponding to an area 172 formed by a pixel unit.

The embodiments of the present disclosure do not limit the number of pixel units included in the area 172 and the number of backlight modules included in the backlight module area A.

In step 230, a first component, a second component, and a third component of the pixel unit in the pixel area in a first color space are acquired.

The first component, the second component, and the third component of each of the pixel units in each of the divided pixel areas in the first color space are acquired, such that an average value Ave R' of the first component, an average value Ave G' of the second component, and an average value Ave B' of the third component of all pixel units in the pixel area can be acquired.

In step 240, a tone angle value and a saturation in a second color space are acquired according to the average value of the first component, the average value of the second component, and the average value of the third component of the pixel unit in the pixel area.

The tone angle value H' and the saturation C' in the second color space can be acquired according to the average value Ave R' of the first component, the average value Ave G' of the second component, and the average value Ave B' of the third component of the pixel unit in the pixel area. Exemplarily, H' can be equal to f1 (Ave R', Ave G', Ave B'), and C' can be equal to f2 (Ave R', Ave G', Ave B').

In step 250, specified lightness of the blue backlight module and the green backlight module in the backlight module area corresponding to the pixel unit in the pixel area are acquired according to the tone angle value and the saturation.

Exemplarily, when the acquired tone angle value H' is greater than 0° and is less than or equal to 45°, or is greater than 315° and is less than or equal to 360°, it can be determined that the pixel unit in the pixel area of the display panel renders a color close to red color, and then the range in which the acquired saturation C' is located is determined. For example, when the acquired saturation C' is greater than C1 and less than C2, it can be determined that the specified lightness of the blue backlight module in the backlight module area corresponding to the pixel unit in the pixel area is A_B1, and the lightness of the green backlight module in the backlight module area corresponding to the pixel unit in the pixel area is A_G1. Referring to FIG. 3, the specified lightness of the blue backlight module 153 and the green backlight module 152 in the backlight module area A disposed corresponding to the area 172 can be acquired according to the tone angle value H' and the saturation C' of the area 172 consisting of the corresponding pixel units.

In step 260, at least one of the following two steps is performed: adjusting lightness of the blue backlight module in the backlight module area according to the specified lightness of the blue backlight module in the backlight module area; and adjusting lightness of the green backlight module in the backlight module area according to the specified lightness of the green backlight module in the backlight module area.

Referring to FIG. 3, the lightness of the blue backlight module 153 in the backlight module area A can be adjusted according to the specified lightness of the blue backlight module 153 in the backlight module area A obtained in the aforementioned steps, or the lightness of the green backlight module 152 in the backlight module area A can be adjusted according to the obtained specified lightness of the green backlight module 152 in the backlight module area A. Alternatively, the lightness of blue backlight module 153 in the backlight module area A can be adjusted according to the specified lightness of the blue backlight module 153 in the backlight module area A, meanwhile the lightness of the green backlight module 152 in the backlight module area A is adjusted according to the specified lightness of the green backlight module 152 in the backlight module area A. Since the specified lightness of the blue backlight module 153 is less than the lightness of the blue backlight module 153 before adjustment, and the specified lightness of the green backlight module 152 is less than the lightness of the green backlight module 152 before adjustment, that is, the adjusted lightness of the blue backlight module 153 in the backlight module area A is configured to the specified lightness to reduce the lightness of the blue backlight module 153 in the backlight module area A, and the adjusted lightness of the green backlight module 152 in the backlight module area A is configured to the specified lightness to reduce the lightness of the green backlight module 152 in the backlight module area A, the light leakage of the short-wavelength light to the red pixel unit is reduced, the problem of severe color shift of the red pixel unit disposed in the backlight module area caused by the short-wavelength light can be solved, thereby optimizing the display effect of the display device.

The pixel units in the display panel are divided into a plurality of pixel areas, the backlight modules in the display panel are divided into a plurality of backlight module areas, and each of the backlight module areas is disposed corresponding to a pixel area consisting of the pixel units, such that an accurate adjustment of the lightness of the blue backlight module and the green backlight module in each of the backlight module areas is achieved.

The drawings of the embodiments of the present disclosure are merely illustrative of the size of each element and do not represent the actual size of each element in the display panel.

Figure 4:
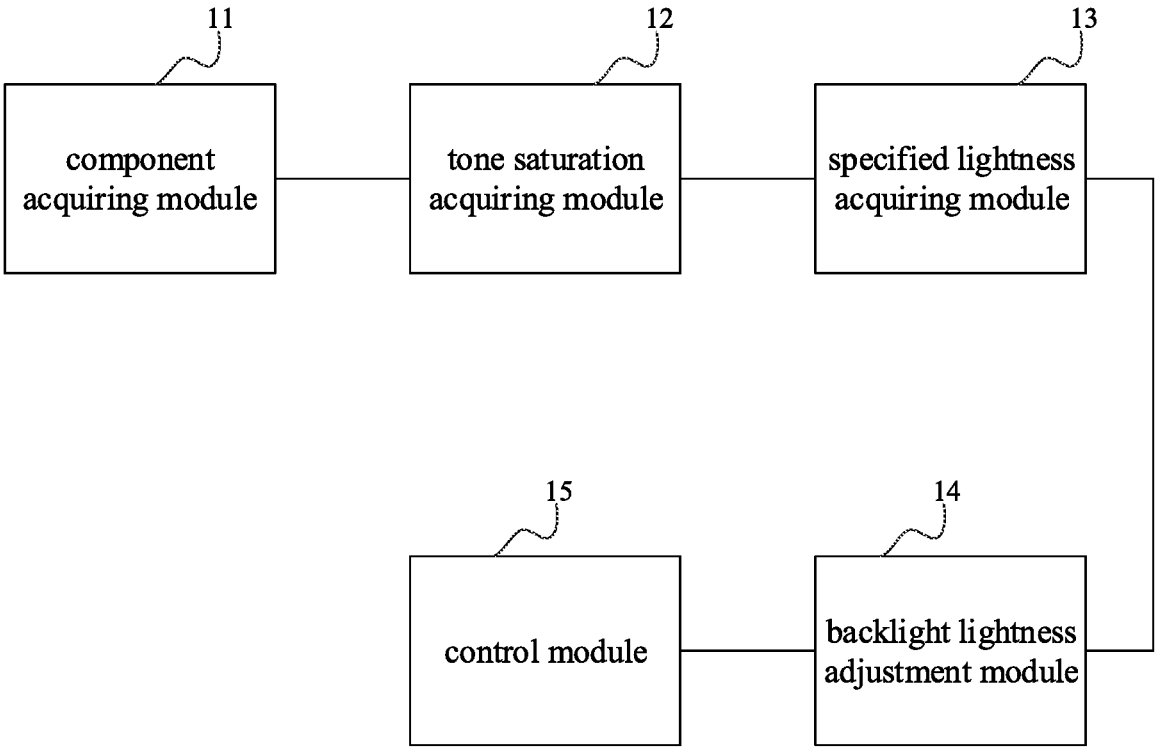
FIG. 4 is a schematic view of another display device according to an embodiment.

FIG. 4 is a schematic view of a backlight adjustment device of a panel device according to the embodiments of the present disclosure. The display panel includes at least one pixel area and at least one backlight module area. The pixel area and the backlight module area are in one-to-one correspondence. Each of the pixel areas includes a plurality of pixel units. Referring to FIG. 4, the backlight adjustment device of the panel device includes a component acquiring module 11, a tone saturation acquiring module 12, a specified lightness acquiring module 13, a backlight lightness adjustment module 14, and a control module 15. The tone saturation acquiring module 12 is electrically coupled to the component acquiring module 11 and the specified lightness acquiring module 13, respectively. The backlight lightness adjustment module 14 is electrically coupled to the specified lightness acquiring module 13 and the control module 15, respectively. The component acquiring module 11 is configured to acquire a first component, a second component, and a third component of each of the pixel units in a pixel area in a first color space. The tone saturation acquiring module 12 is configured to acquire a tone angle value and a saturation in a second color space according to an average value of the first component, an average value of the second component, and an average value of the third component of the pixel unit in the pixel area. The specified lightness acquiring module 13 is configured to acquire specified lightness of a blue backlight module and a green backlight module corresponding to the pixel area according to the tone angle value and the saturation. The backlight lightness adjustment module 14 is configured to perform at least one of the following two steps: adjusting lightness of the blue backlight module according to the specified lightness of the blue backlight module; and adjusting lightness of the green backlight module according to the specified lightness of the green backlight module. The control module 15 is configured to control the specified lightness of the blue backlight module to be less than lightness of the blue backlight module before adjustment, and the specified lightness of the green backlight module to be less than lightness of the green backlight module before adjustment. Exemplarily, the display panel can be a liquid crystal display device, which includes an array substrate, a color film substrate, and liquid crystal molecules located between the array substrate and the color film substrate. The liquid crystal molecules are deflected by the voltage between the array substrate and the color film substrate to achieve the display function of the liquid crystal display device.

Optionally, the backlight adjustment device of the panel device can further include a pixel area dividing module and a backlight area dividing module. The pixel area dividing module is configured to divide the pixel units in the display panel into a plurality of pixel areas, and each of the pixel areas includes a plurality of pixel units. The backlight area dividing module is configured to divide the backlight modules of the display panel into a plurality of backlight module areas, and each of the backlight module areas is disposed corresponding to a pixel area consisting of the pixel units.

Optionally, the component acquiring module can be electrically coupled to the pixel area dividing module and is configured to acquire the first component, the second component, and the third component of the pixel unit in the pixel area in the first color space. The tone saturation acquiring module can be electrically coupled to the pixel area dividing module and is configured to acquire the tone angle value and the saturation in the second color space according to the average value of the first component, the average value of the second component, and the average value of the third component of the pixel unit in the pixel area. The specified lightness acquiring module can be electrically coupled to the backlight area dividing module and is configured to acquire specified lightness of the blue backlight module and the green backlight module in the backlight module area corresponding to the pixel unit in the pixel area according to the tone angle value and the saturation. The backlight lightness adjustment module can be electrically coupled to the backlight area dividing module and is configured to perform at least one of the following two steps: adjusting lightness of the blue backlight module in the backlight module area according to the specified lightness of the blue backlight module in the backlight module area; and adjusting lightness of the green backlight module in the backlight module area according to the specified lightness of the green backlight module in the backlight module area. In other words, the lightness of the blue backlight module in the backlight module area can be adjusted according to the specified lightness of the blue backlight module in the backlight module area, or the lightness of the green backlight module in the backlight module area can be adjusted according to the specified lightness of the green backlight module in the backlight module area. Alternatively, the lightness of blue backlight module in the backlight module area is adjusted according to the specified lightness of the blue backlight module in the backlight module area, and the lightness of the green backlight module in the backlight module area is adjusted according to the specified lightness of the green backlight module in the backlight module area.

Optionally, the specified lightness acquiring module can also be used to acquire the specified lightness of the blue backlight module and the green backlight module according to the saturation, when the tone angle value is greater than 0° and is less than or equal to 45°, or is greater than 315° and is less than or equal to 360°.

The embodiments of the present disclosure further provide a display device, which includes the backlight adjustment device of the aforementioned embodiments, and further includes a backlight module, and a display panel. The backlight adjustment device is electrically coupled to the backlight module for adjusting the lightness of the backlight module.

Figure 5:
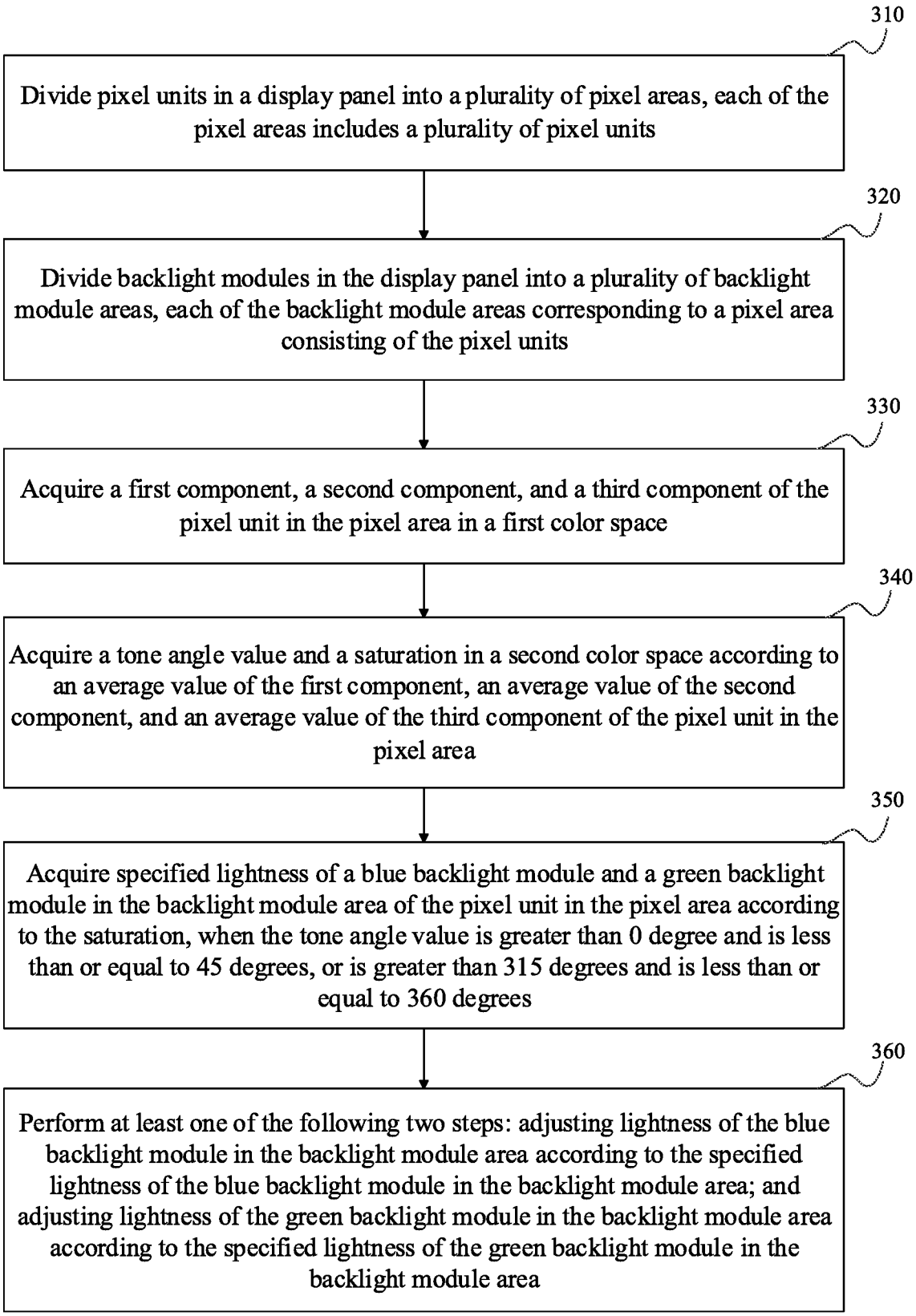
FIG. 5 is a flowchart of another backlight adjustment method of a display panel according to an embodiment.

FIG. 5 is a flowchart of another backlight adjustment method of a display panel according to the embodiments of the present disclosure. The backlight adjustment method can be applied to a scene in which lightness of the backlight module in the display panel is required to be adjusted, and can be performed by the backlight adjustment device of the display panel provided by the embodiments of the present disclosure. The method includes:

In step 310, pixel units in the display panel are divided into a plurality of pixel areas, and each of the pixel areas includes a plurality of pixel units.

In step 320, backlight modules in the display panel are divided into a plurality of backlight module areas, and each of the backlight module areas is disposed corresponding to a pixel area consisting of the pixel units.

In step 330, a first component, a second component, and a third component of the pixel unit in the pixel area in a first color space are acquired.

In step 340, a tone angle value and a saturation in a second color space are acquired according to an average value of the first component, an average value of the second component, and an average value of the third component of the pixel unit in the pixel area.

In step 350, when the tone angle value is greater than 0° and is less than or equal to 45°, or is greater than 315° and is less than or equal to 360°, specified lightness of a blue backlight module and a green backlight module in the backlight module area of the pixel unit in the pixel area are correspond according to the saturation.

In step 360, at least one of the following two steps is performed: adjusting lightness of the blue backlight module in the backlight module area according to the specified lightness of the blue backlight module in the backlight module area; and adjusting lightness of the green backlight module in the backlight module area according to the specified lightness of the green backlight module in the backlight module area. The specified lightness of the blue backlight module is less than lightness of the blue backlight module before adjustment, and the specified lightness of the green backlight module is less than lightness of the green backlight module before adjustment.

In the embodiments of the present disclosure, by acquiring the specified lightness of the blue backlight module and the green backlight module according to the acquired tone angle value and the saturation, and by adjusting the lightness of the blue backlight module according to the acquired specified lightness corresponding to the blue backlight module, and/or adjusting the lightness of the green backlight module according to the specified lightness corresponding to the green backlight module, the specified lightness of the blue backlight module is less than the lightness of the blue backlight module before adjustment, the specified lightness of the green backlight module is less than the lightness of the green backlight module before adjustment. In other words, by reducing the lightness of the blue backlight module or the green backlight module, or simultaneously reducing the lightness of the blue backlight module and the green backlight module, the leakage of short-wavelength light to the red pixel unit is reduced, the problem of severe color shift of the red pixel unit caused by the short-wavelength light can be solved, thereby optimizing the display effect of the display device.

The present embodiment further provides a computer readable storage medium storing computer executable instructions configured to perform any of the above methods.

Figure 6:
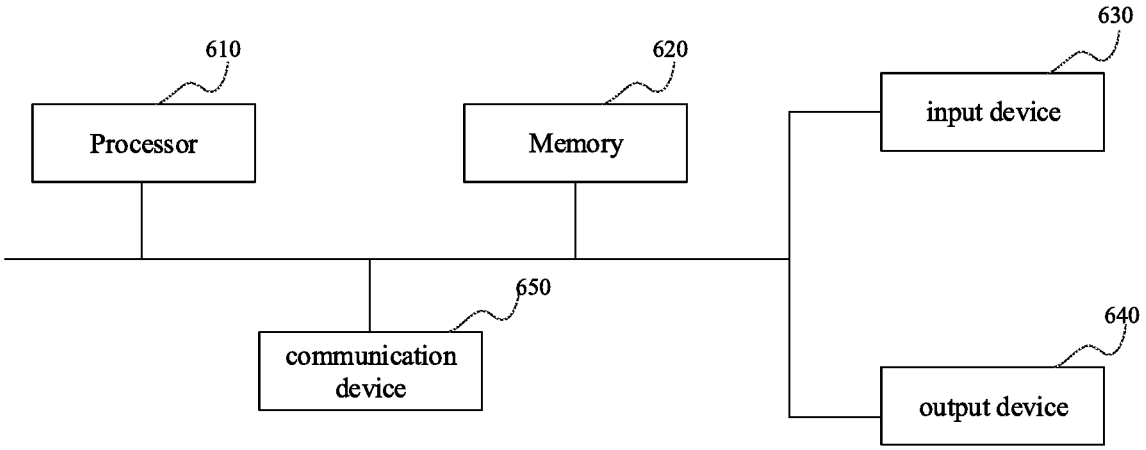
FIG. 6 is a schematic block diagram of a backlight adjustment apparatus according to an embodiment.

FIG. 6 is a schematic block diagram of a backlight adjustment apparatus according to the present embodiment. Referring to FIG. 6, the backlight adjustment apparatus includes one or more processors 610 and a memory 620. One processor 610 is taken as an example in FIG. 6.

The backlight adjustment apparatus can also include an input device 630 and an output device 640.

The processor 610, the memory 620, the input device 630, and the output device 640 in the backlight adjustment apparatus may be connected by a bus or other means, and a bus connection is taken as an example in FIG. 6.

The input device 630 can receive input numeric or character information, and the output device 640 can include display apparatus such as a display screen.

The memory 620 is a computer readable storage medium that can be used to store software programs, computer executable programs, and modules. The processor 610 executes various functional applications and data processing by executing software programs, instructions, and modules stored in the memory 620 to achieve any of the methods in the above embodiments.

The memory 620 can include a storage program area and a storage data area. The storage program area can store an operating system, an application required for at least one function. The storage data area can store data created according to the usage of the backlight adjustment apparatus, and the like. In addition, the memory may include transitory memory such as random access memory (RAM), and may also include non-transitory memory such as at least one magnetic disk storage device, flash memory device, or other non-transitory solid state storage device.

The memory 620 can be a non-transitory computer storage medium or a transitory computer storage medium. The non-transitory computer storage medium can be, for example at least one of magnetic disk storage device, flash memory device, or other non-transitory solid state storage device. In one embodiment, the memory 620 optionally includes a memory remotely located relative to the processor 610, which can be connected to the backlight adjustment apparatus via a network. Examples of the above networks may include the Internet, an intranet, a local area network, a mobile communication network, and combinations thereof.

The input device 630 can be used to receive input numeric or character information and to generate key signal inputs related to user settings and function control of the backlight adjustment apparatus. The output device 640 can include a display apparatus such as a display screen.

The backlight adjustment apparatus of the present embodiment may further include a communication device 650 that transmits and/or receives information over a communication network.

Embodiments of the disclosure may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media, and others.

What is claimed is:

1. A backlight adjustment method of a display panel, wherein the display panel includes at least one pixel area and at least one backlight module area, wherein the pixel area and the backlight module area are in one-to-one correspondence, and wherein each of the pixel areas includes pixel units, the adjustment method comprising:

acquiring first, second, and third components of each of the pixel units in the pixel area in a first color space;

acquiring a hue angle value and a chroma value in a second color space according to an average value of the first component, an average value of the second component, and an average value of the third component of the pixel unit in the pixel area;

acquiring specified lightness of a blue backlight module and a green backlight module in the backlight module area corresponding to the pixel area according to the hue angle value and the chroma value; and performing at least one of adjusting lightness of the blue backlight module according to the specified lightness of the blue backlight module and adjusting lightness of the green backlight module according to the specified lightness of the green backlight module, wherein the specified lightness of the blue backlight module is less than the lightness of the blue backlight module before the adjustment, and the specified lightness of the green backlight module is less than the lightness of the green backlight module before the adjustment, and wherein the step of acquiring specified lightness of a blue backlight module and a green backlight module according to the hue angle value and the chroma value includes acquiring the specified lightness of the blue backlight module and the green backlight module according to the chroma value when the hue angle value is greater than 0 degree and is less than or equal to 45 degrees.

2. The adjustment method of claim 1, wherein the step of acquiring specified lightness of a blue backlight module and a green backlight module according to the hue angle value and the chroma value includes acquiring the specified lightness of the blue backlight module and the green backlight module according to the chroma value when the hue angle value is greater than 315 degrees and is less than or equal to 360 degrees.

3. The adjustment method of claim 1, wherein the first color space is a Red Green Blue (RGB) color space.

4. The adjustment method of claim 1, wherein the second color space is a Lightness Chroma Hue (LCH) color space.

5. The adjustment method of claim 1, wherein the display panel is a liquid crystal display panel.

6. A non-transitory computer readable storage medium storing computer executable instructions configured to perform a method of claim 1.

7. A backlight adjustment method of a display panel, comprising:

dividing pixel units in the display panel into pixel areas, wherein each of the pixel areas include pixel units;

dividing backlight modules in the display panel into backlight module areas, wherein each of the backlight module areas correspond to a pixel area consisting of the pixel units;

acquiring first, second, and third components of each of the pixel units in the pixel area in a first color space;

acquiring a hue angle value and a chroma value in a second color space according to an average value of the first component, an average value of the second component, and an average value of the third component of the pixel unit in the pixel area;

acquiring specified lightness of a blue backlight module and a green backlight module in the backlight module area of the pixel unit in the pixel area according to the chroma value when the hue angle value is greater than 0 degree and is less than or equal to 45 degrees, or is greater than 315 degrees and is less than or equal to 360 degrees; and performing at least one of adjusting lightness of the blue backlight module in the backlight module area according to the specified lightness of the blue backlight module in the backlight module area and adjusting lightness of the green backlight module in the backlight module area according to the specified lightness of the green backlight module in the backlight module area;

wherein the specified lightness of the blue backlight module is less than the lightness of the blue backlight module before the adjustment, and the specified lightness of the green backlight module is less than the lightness of the green backlight module before the adjustment.

8. The adjustment method of claim 7, wherein the first color space is a Red Green Blue (RGB) color space.

9. The adjustment method of claim 7, wherein the second color space is a Lightness Chroma Hue (LCH) color space.

10. The adjustment method of claim 7, wherein the display panel is a liquid crystal display panel.

* * * * *